United States Patent [19]

Groom

[11] Patent Number: 4,987,934

[45] Date of Patent: Jan. 29, 1991

[54] CLEANER FOR FILLER NOZZLES

[75] Inventor: Stanley A. Groom, Hoopeston, Ill.

[73] Assignee: FMC Corporation, Chicago, Ill.

[21] Appl. No.: 375,647

[22] Filed: Jul. 5, 1989

[51] Int. Cl.[5] ..... B67C 3/26

[52] U.S. Cl. ..... 141/89; 141/65; 141/90; 141/93

[58] Field of Search ..... 141/89, 90, 91, 93, 141/86, 87, 88, 65

[56] References Cited

U.S. PATENT DOCUMENTS

| | | | |
|---|---|---|---|
| 2,081,669 | 5/1937 | Hughes | 141/90 |
| 2,330,862 | 10/1943 | Bleam | 141/91 |
| 3,211,190 | 10/1965 | Vogt | 141/89 |
| 3,999,949 | 12/1976 | Andersson et al. | 141/90 |
| 4,579,156 | 4/1986 | Graffin | 141/89 |
| 4,718,465 | 1/1988 | Dugan | 141/89 |
| 4,751,948 | 6/1988 | Hertig et al. | 141/67 |
| 4,865,225 | 9/1989 | Chavez et al. | 141/86 |

FOREIGN PATENT DOCUMENTS

| | | | |
|---|---|---|---|
| 855290 | 11/1960 | United Kingdom | 141/88 |

*Primary Examiner*—Ernest G. Cusick

*Attorney, Agent, or Firm*—Ronald C. Kamp; R. B. Megley

[57] ABSTRACT

A cleaner for a filler which includes a plurality of cylinders arranged in a circle and rotated with a nozzle associated with each cylinder wherein an upper seal encircles and rotates with the cylinders, a vacuum manifold having a cavity is fixed against rotation, a seal plate attached to the top of the manifold forms with the upper seal, a flow chamber with the nozzles positioned therein and a seal plate provides communication between the flow chamber and the cavity.

6 Claims, 2 Drawing Sheets

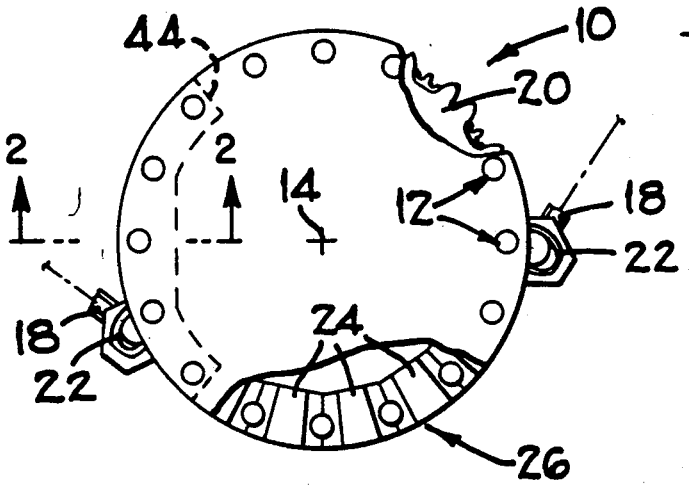
FIG_1
FIG_2
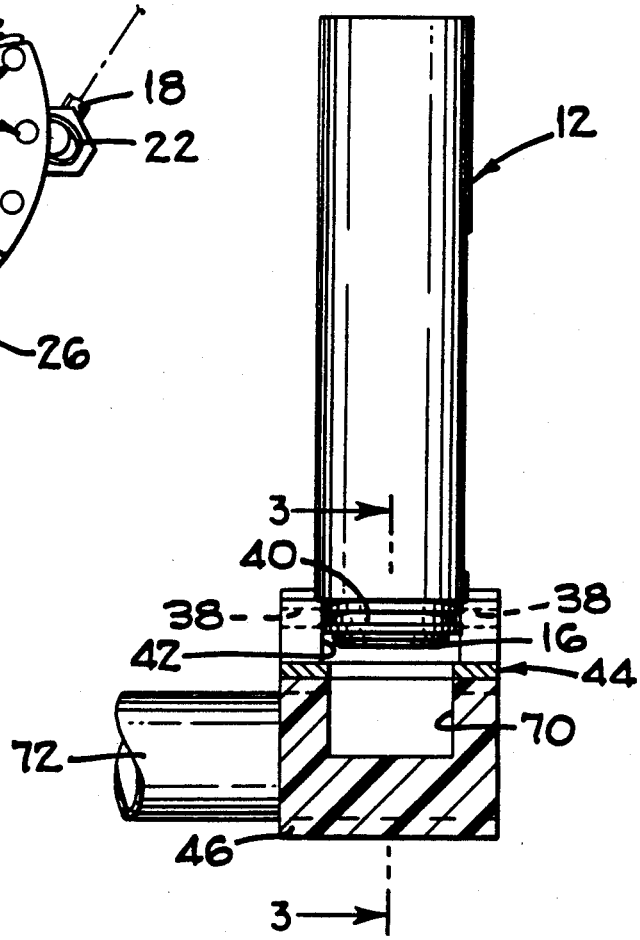
FIG_3
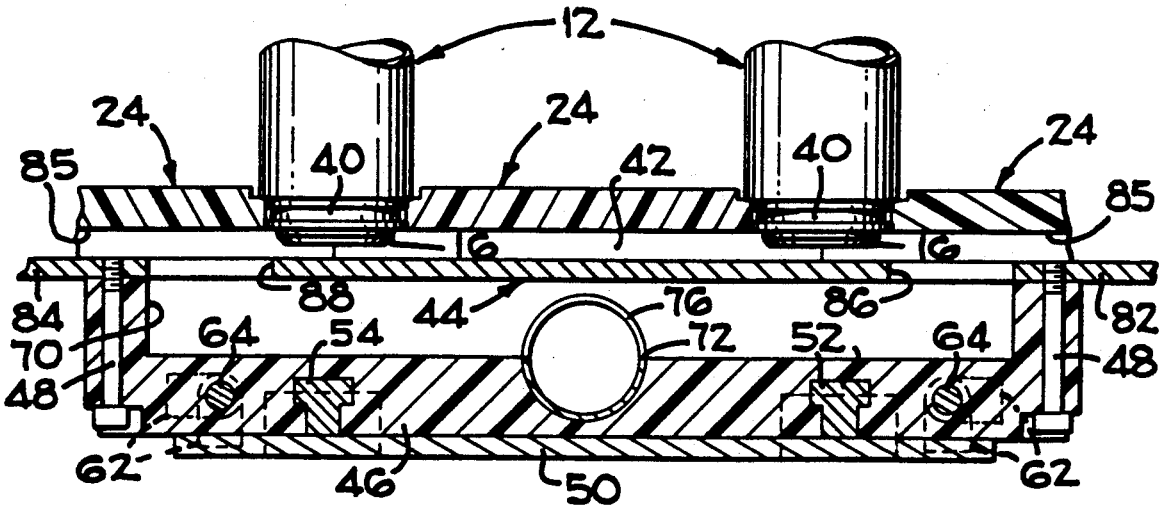

CLEANER FOR FILLER NOZZLES

This invention relates to a cleaner for filler nozzles, and more particularly to such a cleaner which removes excess product from the filler nozzles during operation of the filler.

A filler places product, such as food stuffs, into containers, which are then sealed by lids. Contamination of the sealing area by product falling onto, or otherwise contacting, this area will render the seal between the lid and the container ineffective, and hence, the resulting package unusable. It is important, therefore, to maintain the seal area of the container free from contamination.

The present invention provides a means which maintains the seal area of containers free from contamination, which controls both solid and liquid and thus is especially useful with piston-type fillers, which may be quickly and easily removed from the filler for cleaning and then just as quickly and easily replaced, which is reliable and which is relatively economical to manufacture and maintain.

Those and other advantages of the present invention will become more readily apparent from a perusal of the following detailed description of a preferred embodiment and the accompanying drawing, wherein:

FIG. 1 is a horizontal section representation of a piston-type filler incorporating the present invention.

FIG. 2 is a sectional view taken on line 2—2 of FIG. 1.

FIG. 3 is a sectional view taken on line 3—3 of FIG. 2.

Figure 4:
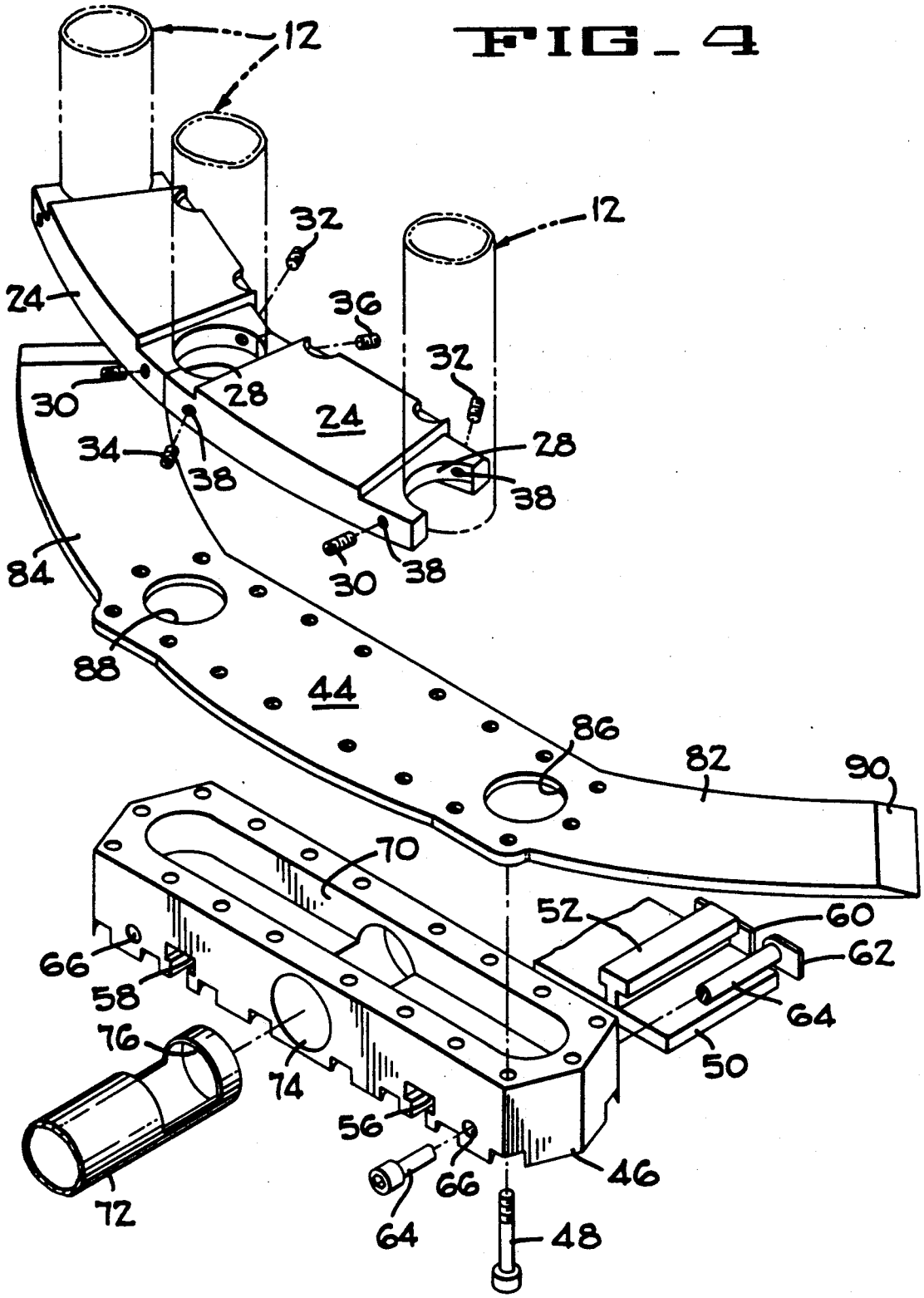
FIG. 4 is an expanded view of the structure shown in FIGS. 2 and 3.

Referring now to FIG. 1, there is shown a piston filler, indicated generally at 10, which may be a C-series M&S piston filler, for example. The filler 10 typically has a plurality of pistons reciprocable in cylinders 12 equiangularly positioned around the periphery thereof. The pistons are moved upward as the filler 10 is rotated about its vertical axis 14 to fill the cylinders 12 with product which is then discharged through a nozzle 16, shown in FIGS. 2 and 3, formed at the lower end of each cylinder. A chain 18 engages a gear 20 attached to the filler 10 and carries containers 22 past the filler. The chain and gear cooperate to position each container 22 under a cylinder 12 so that product discharged from the associated nozzle 16 is received by the container.

A plurality of arcuate vacuum seal blocks 24 are arranged around the periphery of the filler 10 to form an upper vacuum seal 26. Each block 24 extends between two adjacent cylinders 12 and is formed with a semicircular notch 28 at each end to engage the cylinders. Each block 24 is secured in place by four set screws 30, 32, 34 and 36 which extend through threaded holes 38 in the block and engage an annular groove 40 formed in the lower end of the cylinders 12. The circumferential ends of each block abut the adjacent ends of the blocks on each side thereof and completely encircle the cylinders 12 to form the circular upper vacuum seal 26. A circumferential groove 42 is formed in the lower surface of each block 24 to provide clearance for the lower end of the nozzle 16.

A seal plate 44 is secured to a manifold 46 by a plurality of bolts 48. The manifold 46 is supported on a stationery shelf 50 attached to a non-rotating portion of the filler. The shelf 50 has a pair of T-shaped lugs 52 and 54 attached to its upper surface. The lugs 52 and 54 mate with a pair of complementary T-shaped grooves 56 and 58 formed in the manifold 46. The manifold 46, and the attached seal plate 44, can be positioned with the grooves 56 and 58 aligned with the lugs 52 and 54 and then pushed toward the filler 10 until the manifold 46 contacts plates 60 attached at the inner edge of the shelf 50 and the lugs 52 and 54. The plates 60 position the seal plate 44 radially so that it is under the upper seal 26. The manifold 46 is held in this position by a pair of lock bars 62 affixed to the end of headed lock rods 64. The rods 64 extend through holes 66 of a diameter smaller than the head but larger than the rod itself in the manifold 46. Turning the rod 64 so that the lock bar 62 is behind the shelf 50 will secure the manifold 46 and the seal plate 44 to the shelf 50. The manifold 46 and seal plate 44 can be readily removed for cleaning by simply turning the rods 64 to position the lock bar 62 to clear the shelf 50, as shown in FIGS. 3 and 4.

The manifold 46 has a central cavity 70 which communicates with a vacuum tube 72, which is connected at its outer end with a vacuum source. The tube 72 is seated in a blind cylindrical hole 74 extending through the outer side of the manifold 46 and across the cavity 70 with its centerline positioned substantially in the plane of the lower surface of cavity 70. The tube 72 has a slot 76 extending transverse to the centerline of the tube and a width substantially equal to the width of the cavity 70. The bottom of the slot 76 is level with the bottom of the cavity 70 so that any material entering the cavity may be drawn into the tube 72 through the slot 76. The hole 74 extends partially through the inner wall of the manifold 46 and provides a seat, and thus stability, for the tube 72.

The seal plate 44 is sealed to the manifold 46 by the bolts 48 and has arcuate extensions 82 and 84 on each end which extend under the upper seal 26 and form a flow chamber 85 with the grooves 42. A pair of holes 86 and 88 in the seal plate 44 are positioned to provide communication with each end of the cavity 70 in the manifold 46 and the flow chamber 85. The free end of the extension 82 is beveled at 90 to direct air flow, as a result of the vacuum, upward into the chamber 85, and is positioned to be adjacent the exit of the chain 18 from the filler 10. Thus, any liquid dripping from the nozzle 16 that has just filled a container would be sucked into the chamber 85 by the air flow. Also, any solid particles clinging to the nozzle or strings trailing therefrom will be drawn into the chamber 85. Any drips of liquid or solid material falling from the nozzle 16 after it has passed the manifold 46 will be caught by the extension 84. The air flow relative to the nozzle 16 increases over the extension 84 because the velocity of the air flow is added to the velocity of the nozzle due to rotation of the filler. The cleaning action is, therefore, efficient and minimizes the possibility of material being dropped onto the sealing lip of a container during its entrance to the filler. The entire manifold 46 and seal plate 44 may be removed quickly and easily for cleaning. The manifold 46, and blocks 24 are preferable made from a polyethylene material, such as ultra high molecular weight polyethylene and the seal plate 44 from stainless steel, which materials are suitable for use with food stuffs.

While one embodiment of the present invention has been illustrated and described herein, it is to be understood that various changes and modifications may be made without departing from the spirit of the invention as defined by the scope of the appended claims.

What is claimed is:

1. A cleaner for a filler having a plurality of cylinders arranged in a circle and rotatable as a unit about the center thereof, each cylinder having a nozzle at its lower end for depositing product into a container conveyed therewith during a portion of each rotation of said filler; said cleaner comprising:

a vacuum manifold having a cavity mounted on said filler and fixed against rotation;

means connecting said cavity to a vacuum source;

a seal plate attached to the top of said manifold;

an upper seal means encircling all of said cylinders and rotatable therewith;

a circumferential groove 42 formed in the seal means; and said nozzles being positioned in said groove whereby said vacuum source draws air past said nozzles to cause product on said nozzles to be swept into said cavity.

2. The invention according to claim 1, and further comprising:

a shelf affixed to said filler;

a pair of lugs on said shelf;

said manifold having slots complementary to and engageable with said lugs;

a plate at the end of each lug to position said manifold radially of said filler; and means securing said manifold against said plates.

3. The invention according to claim 1 wherein said upper seal is formed by a plurality of seal blocks;

each seal block extending between and engaging adjacent ones of said cylinders.

4. The invention according to claim 1, wherein said seal plate includes an extension on each end; and each extension extends radially beyond said manifold.

5. The invention according to claim 4, wherein the free ends of said extension includes an angled portion to direct air flow upward into said flow chamber.

6. The invention according to claim 5 and further comprising:

a shelf affixed to said filler;

a pair of lugs affixed to said shelf;

said manifold having slot complementary to and engageable with said lugs;

limit means on said shelf to radially position said manifold; and quick release means for securing said manifold to said shelf.

* * * * *